US008561586B2

(12) United States Patent
Kishi et al.

(10) Patent No.: US 8,561,586 B2
(45) Date of Patent: Oct. 22, 2013

(54) ROCKER ARM UNIT AND METHOD OF ASSEMBLING ROCKER ARM UNIT

(75) Inventors: Masateru Kishi, Nishio (JP); Kimihiko Todo, Aichi (JP)

(73) Assignee: OTICS Corporation, Aichi (JP)

( * ) Notice: Subject to any disclaimer, the term of this patent is extended or adjusted under 35 U.S.C. 154(b) by 420 days.

(21) Appl. No.: 12/920,748

(22) PCT Filed: Feb. 16, 2009

(86) PCT No.: PCT/JP2009/052551

§ 371 (c)(1),
(2), (4) Date: Sep. 2, 2010

(87) PCT Pub. No.: WO2009/110297

PCT Pub. Date: Sep. 11, 2009

(65) Prior Publication Data

US 2011/0017160 A1 Jan. 27, 2011

(30) Foreign Application Priority Data

Mar. 7, 2008 (JP) ..... 2008-058472

(51) Int. Cl.
*F01L 1/18* (2006.01)

(52) U.S. Cl.
USPC ..... 123/90.43; 123/90.45

(58) Field of Classification Search
USPC ..... 123/90.41, 90.43–45
See application file for complete search history.

(56) References Cited

U.S. PATENT DOCUMENTS 3,002,507 A 10/1961 Bensinger
4,494,729 A 1/1985 Krüger
5,325,825 A * 7/1994 Schmidt et al. ..... 123/90.39
5,775,280 A * 7/1998 Schmidt et al. ..... 123/90.41
6,047,675 A * 4/2000 Kunz ..... 123/90.41

(Continued)

FOREIGN PATENT DOCUMENTS

DE 2 309 460 A1 8/1974
DE 3118466 11/1982

(Continued)

OTHER PUBLICATIONS

Supplementary European Search Report dated Mar. 4, 2011 for Application No. EP 09 71 7250.

(Continued)

*Primary Examiner* — Thomas Denion
*Assistant Examiner* — Steven D Shipe
(74) *Attorney, Agent, or Firm* — Smith, Gambrell and Russell, LLP.

(57) ABSTRACT

A rocker arm unit which constitutes a valve gear of an internal combustion engine, includes a lash adjuster including a cylindrical body and a plunger formed into a cylindrical shape and accommodated in the body, a rocker arm extending in a direction perpendicular to a vertical direction, and a clip configured to be fixed to an upper end of the body and formed with a retainer having a retaining portion which is configured to be swaged onto an inner circumferential surface of the upper end of the body. The clip has an extension extending integrally from the retainer. The extension has an upper end engaged with the rocker arm to prevent the rocker arm from falling off the lash adjuster. The retaining portion is configured to abut against the stepped portion of the plunger from above to prevent the plunger from coming off upwardly out of the body.

9 Claims, 5 Drawing Sheets

(56) References Cited

U.S. PATENT DOCUMENTS

| | | | | |
|---|---|---|---|---|
| 6,543,402 | B2 * | 4/2003 | Burns | 123/90.41 |
| 6,941,915 | B1 * | 9/2005 | Masello et al. | 123/90.52 |
| 7,089,900 | B2 * | 8/2006 | Masello et al. | 123/90.45 |
| 7,146,950 | B2 * | 12/2006 | Moeck et al. | 123/90.44 |
| 7,219,639 | B2 | 5/2007 | Engelhardt et al. | |
| 7,350,490 | B2 * | 4/2008 | Mock et al. | 123/90.39 |
| 2001/0035144 | A1 | 11/2001 | Burns | |
| 2006/0225680 | A1 | 10/2006 | Engelhardt et al. | |
| 2011/0000451 | A1 * | 1/2011 | Kraus | 123/90.46 |
| 2011/0041791 | A1 | 2/2011 | Miyoshi et al. | |

FOREIGN PATENT DOCUMENTS

| | | | |
|---|---|---|---|
| DE | 196 17 523 | A1 | 11/1997 |
| DE | 197 14 822 | A1 | 10/1998 |
| GB | 963995 | | 7/1964 |
| JP | 59-168208 | | 9/1984 |
| JP | 60-32504 | | 3/1985 |
| JP | 60-198313 | | 10/1985 |
| JP | 62-169203 | | 10/1987 |
| JP | 64-25409 | | 2/1989 |
| JP | 2520603 | | 10/1996 |
| JP | 10-37719 | | 2/1998 |
| JP | 2001-271614 | | 10/2001 |
| JP | 2001-317310 | | 11/2001 |
| JP | 2002-155710 | | 5/2002 |
| JP | 2002155710 | A * | 5/2002 |
| JP | 2004-278377 | | 10/2004 |
| JP | 2009-257313 | | 11/2009 |
| WO | 2004/038186 | A1 | 5/2004 |
| WO | 2009/038935 | | 3/2009 |

OTHER PUBLICATIONS

International Search Report for PCT/JP2009/052551 dated May 12, 2009 (English and JP language version).

Partial English language translation of an excerpt from the Japanese Office Action mailed Apr. 9, 2013 for Japanese Application No. 2009-189208.

* cited by examiner

ROCKER ARM UNIT AND METHOD OF ASSEMBLING ROCKER ARM UNIT

BACKGROUND

The present invention relates to a rocker arm unit constituting a valve gear of an internal combustion engine and a method of assembling the rocker arm unit.

RELATED ART

A known valve gear which opens and closes a valve by rotation of a cam comprises a rocker arm and a lash adjuster. Japanese patent application publication JP-A-2004-278377 discloses a valve gear in which a rocker arm is located below a cam and a roller is mounted on a central part of the rocker arm so as to abut against the cam. The rocker arm has one of two ends which is supported on an upper end of a plunger and the other end which is in abutment with an upper end of a valve. When rotation of the cam swings the rocker arm with the upper end of the plunger serving as a fulcrum, the valve is opened and closed alternately so that a valve clearance is automatically adjusted by the lash adjuster.

Assembling a rocker arm and a lash adjuster together includes (1) a step of mounting the lash adjuster on a cylinder head, (2) a step of placing both ends of the rocker arm on upper ends of the lash adjuster and of the valve respectively and (3) disposing a cam above the rocker arm, the steps being executed sequentially. However, the cam and the rocker arm interfere with each other in step (3), whereupon there is a possibility that the rocker arm may drop out of the lash adjuster. This results in a low assembling efficiency and failure in the assembling. Furthermore, since the rocker arm is supported only by the valve and the plunger in step (2), there is a possibility that the rocker arm may lose a balance to drop in step (2) despite non occurrence of the aforesaid interference.

In view of these problems, the rocker arm and the plunger may be connected together by a clip, for example. However, when contact portions of the plunger and the rocker arm are tightly fixed to each other by the clip, the smoothness is reduced in a swinging operation of the rocker arm.

SUMMARY OF THE INVENTION

The present invention was made in view of the foregoing circumstances and an object thereof is to improve the efficiency in the assembling of the rocker arm unit and to ensure smoothness in the swinging operation of the rocker arm.

The present invention provides a rocker arm unit comprising a lash adjuster having a plunger extending axially and a cylindrical body which houses the plunger so that the plunger is slidable; a rocker arm supported by an upper end of the plunger and swung with the supported position serving as a pivot; and a clip which is fixed to the body so as to extend from the fixed position to engage the rocker arm, thereby restricting drop of the rocker arm out of the lash adjuster.

Furthermore, the invention provides a method of assembling the rocker arm unit as described in claim 1, comprising fixing the clip to the body; pressing the plunger downward so that an insertion space for the rocker arm is defined between the clip and the plunger; inserting the rocker arm into the insertion space; and releasing the plunger from a pressed state thereby to urge the plunger upward so that the rocker arm is interposed between the clip and the plunger.

According to the above-described rocker arm unit, the clip extending from the lash adjuster side is engaged with the rocker arm thereby to limit dropout of the rocker arm from the lash adjuster. Consequently, the rocker arm and the lash adjuster can be handled together, whereupon the assembling efficiency can be improved. Furthermore, since the clip is fixed to the body of the lash adjuster, the supporting point between the plunger and the rocker arm is prevented from being subjected directly to the fixing force of the clip. Consequently, the smoothness in the swing of the rocker arm can be ensured.

According to the above-described rocker arm unit assembling method, the rocker arm is assembled by making use of rising force of the plunger. Accordingly, the rocker arm can be assembled easily. Furthermore, in the case where the clip is resiliently abuttable against the rocker arm, the insertion space can be spread with resilient deformation of the clip when the rocker arm is inserted into the insertion space. Consequently, the workability can be improved in the assembly of the rocker arm unit.

DETAILED DESCRIPTION

Figure 1:
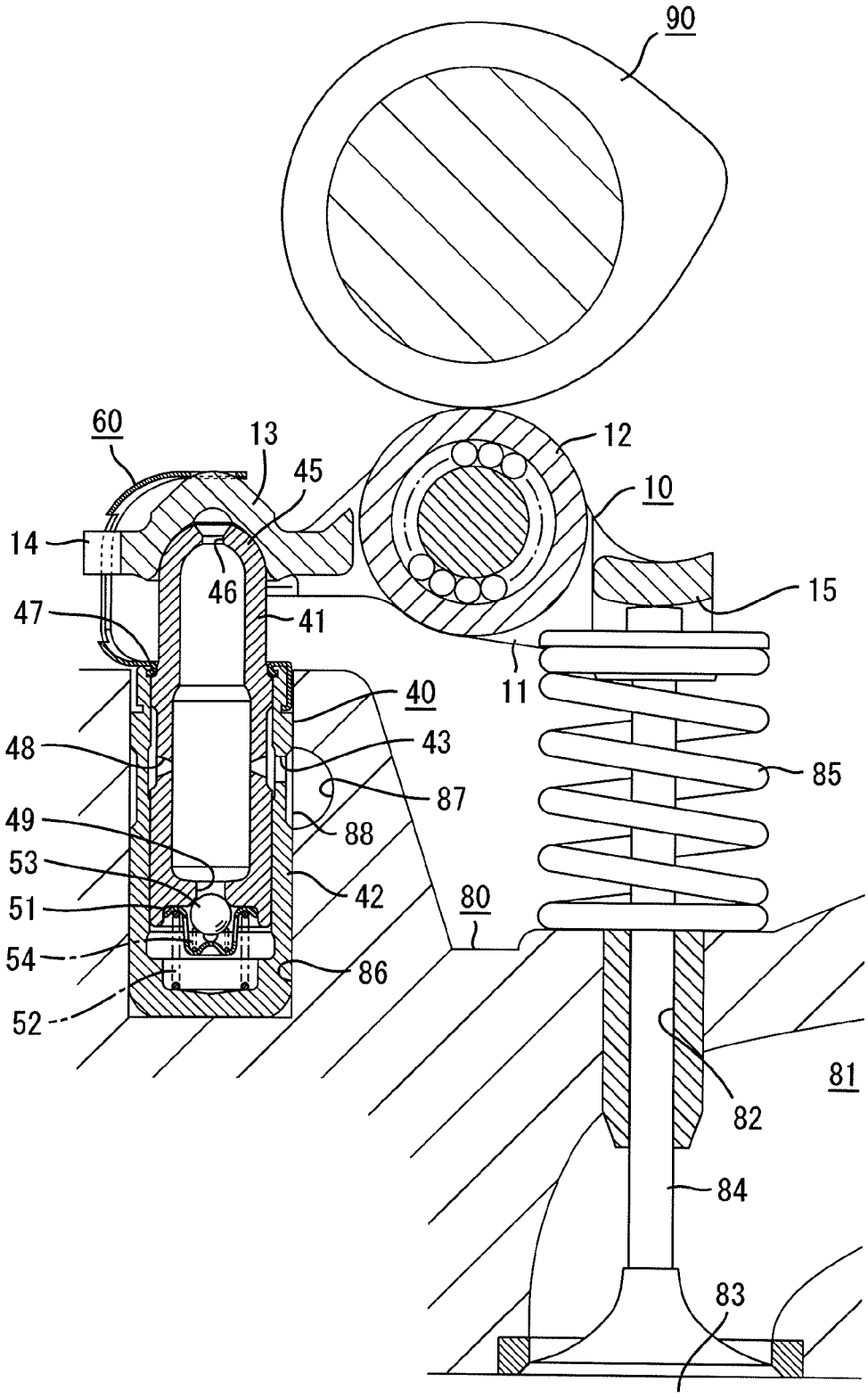
FIG. 1 is a sectional view of a valve gear including the rocker arm unit according to one embodiment.

An overall structure of a valve gear of an internal combustion engine will first be described. A block-like cylinder head 80 is formed with a ventilation passage 81 (an intake port or an exhaust port) and a stem hole 82 which communicates with the ventilation passage 81 and is open in an outer surface of the cylinder head 80, as shown in FIG. 1. A valve 84 (an intake valve or an exhaust valve) is provided in the stem hole 82 so as to be vertically reciprocable between an opening position and a closing position thereby to open and close a vent hole 83 facing the ventilation passage 81. The valve 84 is normally biased in a valve-closing direction (upward) by a valve spring 85 and includes an upper end protruding upward from an upper opening of the stem hole 82.

A rocker arm 10 driving the valve 84 and a cam 90 are provided above the cylinder head 80. A lash adjuster 40 is provided in a mounting recess 86 formed in an outer surface of the cylinder head 80. An oil flow passage 87 is formed in the cylinder head 80. An oil hole 88 is formed in the middle of the oil flow passage 87 so as to face an inner surface of the mounting recess 86.

Figure 2:
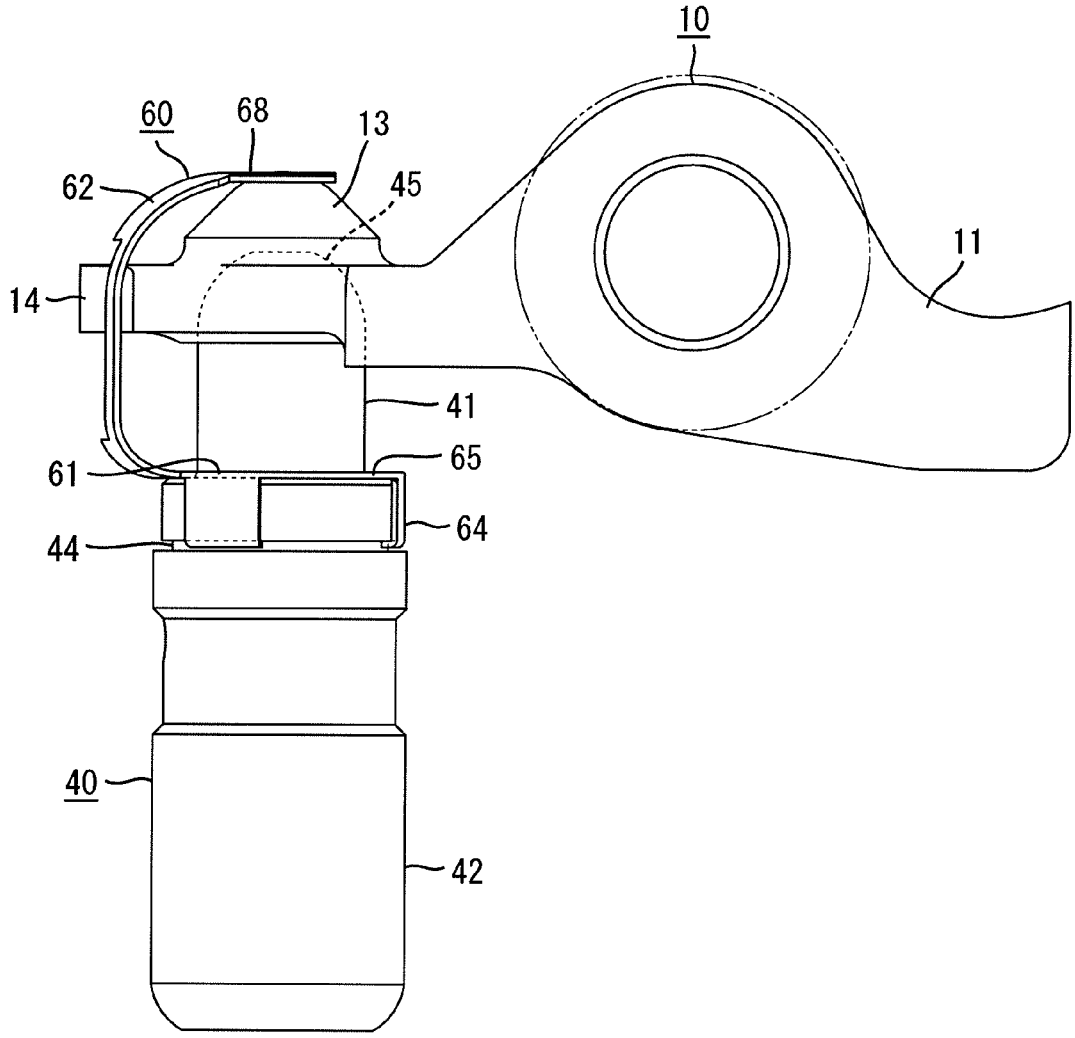
FIG. 2 is a side view of the rocker arm unit.

The lash adjuster 40 includes a plunger 41 which has an upper end supporting the rocker arm 10 and is elongated axially (vertically), and a body 42 in which the plunger 41 is housed so as to be axially slidable and which is fitted in the mounting recess. The body 42 is formed into a bottomed cylindrical shape extending axially and has a circumferential wall formed with a body hole 43 placed opposite the oil hole 88 of the oil flow passage 87. As shown in FIG. 2, the body 42 has an upper end further having an outer circumferential surface in which a locking groove 44 for locking a clip 60 is formed so as to extend over an entire circumference, as will be described later.

The plunger 41 is formed into a generally cylindrical shape and has an upper end formed with a hemispherically rounded support 45. The support 45 has a central portion (apex) through which a through hole 46 is formed so as to extend vertically as shown in FIG. 1. Operating oil is supplied through the through hole to the rocker arm 10. The plunger 41 has an outer circumferential surface formed with a stepped portion 47 which is located substantially on a level with the upper edge of the body 42. An upper part of the plunger 41 extending from the stepped portion 47 has a smaller diameter than a lower part of the plunger 41 extending downward from the stepped portion 47.

The plunger 41 has an interior serving as a low-pressure chamber, and a high-pressure chamber is defined between the underside of the plunger 41 and a bottom of the body 42. The plunger 41 has a plunger hole 48 which is formed through the circumferential wall thereof so as to correspond to the body hole 43. The plunger 41 further has a communication hole 49 which is formed through the bottom thereof and communicates with both high-pressure and low-pressure chambers.

A cage 51 is provided in the high-pressure chamber and pressed against the underside of the plunger 41 by a biasing force of a first spring 52 which is in abutment with a bottom surface of the body 42. Furthermore, a spherical check valve 53 is provided in the high-pressure chamber so as to open and close the communication hole 49 while being adapted to limit radial (the direction perpendicular to the axis) displacement relative to the cage 51. A second spring 54 is provided between the cage 51 and the check valve 53. The check valve 53 is normally biased upward by the second spring 54. The check valve 53 is adapted to be opened only when the fluid pressure in the low-pressure chamber is increased higher than the fluid pressure in the high-pressure chamber.

Figure 5:
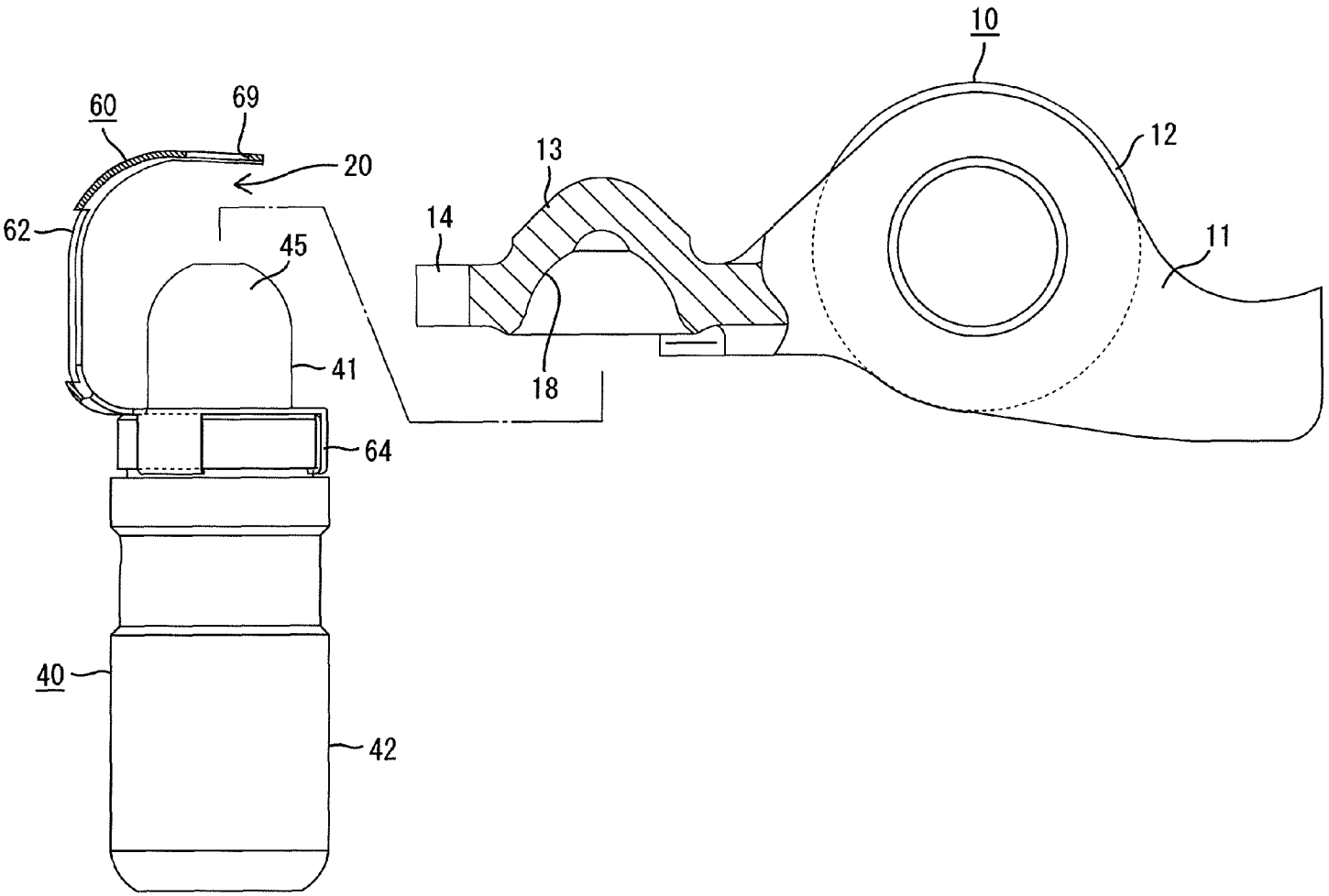
FIG. 5 is a side view of the lash adjuster and the rocker arm before the rocker arm is assembled onto the lash adjuster.

The rocker arm 10 includes an arm body 11 and a roller 12 mounted on a middle part of the arm body 11 as shown in FIG. 5. The roller 12 has an upper end protruding higher than the arm body 11 and is abutted against an outer peripheral surface of a generally oval cam 90 from below. The cam 90 is mounted on a rotational shaft in parallel with a central axis of the roller 12. The arm body 11 is disposed so as to straddle the upper ends of the lash adjuster 40 and the valve 84. The arm body 11 has one of two ends which is formed with a bearing 13 expanded upward substantially into a semispherical shape (a dome shape) so as to receive the support 45 of the plunger 41. The bearing 13 has an inner surface formed into a concave sphere corresponding to the support 45 thereby to serve as a bearing surface 18 on which an outer surface of the support 45 is slidable. The aforementioned end of the arm body 11 further has a protrusion 14 which is formed so as to protrude from the outer edge of the bearing 13 lengthwise outward. The arm body 11 has the other end formed with a valve abutment 15 which is abutted against an upper end of the valve 84 from above, as shown in FIG. 1.

The clip 60 which holds the rocker arm 10 and the lash adjuster 40 together will now be described. The clip 60 is made of a metal and includes a retainer 61 mounted on the body 42 and an extension 62 which extends together with the retainer 61. The retainer 61 has an annular portion 63 attached to an entire circumference of the upper end of the body 42 and three locking claws 64 protruding downward from an outer circumferential edge of the annular portion 63. The locking claws 64 are circumferentially spaced away from one another and have respective distal ends which are inwardly bent thereby to be locked by the wall of a locking groove 44 of the body 42. The annular portion 63 has an inner circumferential edge formed with a retaining portion 65 which is swaged on an inner circumferential surface of the upper end of the body 42. The retaining portion 65 is abutted against the stepped portion 47 of the plunger 41 thereby to prevent the plunger 41 from coming off upwardly.

The extension 62 is bent outward into a curved shape from the outer peripheral edge of the annular portion 63 or more specifically, from a location on the outer peripheral end of the annular portion 63 between the adjacent locking claws 64. The extension 62 has a rising portion 66 which rises substantially upright from the curved surface and is then bent inward (the other end side of the arm body 11) from a rising end into a curved shape. The rising portion 66 has a springiness so as to be flexible with a part thereof connected to the annular portion 63 serving as a fulcrum. The rising portion 66 is disposed along sides of the upper end of the plunger 41 and the bearing 13 of the rocker arm 10. The rising portion 66 has an opening 67 which is formed into a vertically long rectangular shape and through which a protrusion 14 extends. The protrusion 14 has two side edges 141 and 142 which are abutted against both side inner edges of the opening 67 in the direction of movement about an axis of the rocker arm 10 respectively. This limits displacements of the clip 60 and the rocker arm 10 relative to each other.

Furthermore, the extension 62 has a generally square plate-shaped presser portion 68 which extends inward together with an upper end of the rising portion 66 substantially horizontally and can press the bearing 13 of the rocker arm 10 from above. The presser portion 68 is formed with a circular opening or entry hole 69 into which the upper end side of the bearing 13 enters. The upper end of the bearing 13 has an outer circumference which is allowed to abut against an inner edge of the entry hole 69 of the presser portion 68 over an entire circumference thereof. The rocker arm unit comprises the rocker arm 10, the lash adjuster 40 and the clip 60. A whirl-stop portion comprises the opening 67 of the clip 60, and a supported position comprises the bearing surface 18 of the bearing 13.

An assembling procedure will now be described. After assembly of the lash adjuster 40, the retainer 61 of the clip 60 is swaged on the upper edge of the body 42 of the lash adjuster 40, whereby the clip 60 is fixed to the body 42. As a result, the retaining portion 65 of the retainer 61 abuts against the stepped portion 47 of the plunger 41 thereby to prevent the plunger 41 from coming off upwardly. Subsequently, the plunger 41 is pressed down into the bottom wall side of the body 42 against the biasing force of the first spring 52, so that the insertion space 20 into which the rocker arm 10 is insertable is defined between the presser portion 68 of the clip 60 and the support 45 of the plunger 41, as shown in FIG. 5. The bearing 13 of the rocker arm 10 is laterally inserted into the insertion space 20 while the plunger 41 is kept pressed. In this case, the presser portion 68 is lifted upward so as to spread the insertion space 20 while the extension 62 of the clip 60 is flexed, whereby the bearing 13 is smoothly inserted into the insertion space 20.

When the protrusion 14 of the rocker arm 10 enters into the opening 67 of the retainer 61 such that the rocker arm 10 is assembled so as to occupy a normal position, the plunger 41 is released from the pressed state. The plunger 41 is then biased by the first spring 52 thereby to be moved upward, reaching the uppermost position. When the retaining portion 65 of the retainer 61 then abuts against the stepped portion 47, the support 45 of the plunger 41 is fitted into the bearing 13 of the rocker arm 10 from below, the bearing 13 is fitted into the entry hole 69 of the presser portion 68 from below, and the bearing 13 abuts against the presser portion 68 in a pressed state, as shown in FIG. 2. Consequently, the rocker arm unit is completed.

The rocker arm unit is then assembled into the valve gear. In the assembling, the lash adjuster 40 is disposed so as to face the mounting recess 86 of the cylinder head 80 from above, and the valve abutment 15 is disposed so as to face the upper end of the valve 84 from the above. When the whole rocker arm unit is lowered, the lash adjuster 40 is fitted into the mounting recess 86, and the valve abutment 15 of the rocker arm 10 is placed on the upper end of the valve 84, whereupon the rocker arm unit is supported on both ends of the rocker arm 10. The cam 90 is thereafter located above the rocker arm 10. In this case, the cam 90 is brought into contact with the roller 12 of the rocker arm 10 from above, so that the clip 60 and the rocker arm 10 are spaced from each other.

However, the lash adjuster 40 may independently be inserted into the cylinder head 80 and thereafter, the clip 60 and the rocker arm 10 may be assembled into the lash adjuster 40 with the clip 60. Alternatively, the lash adjuster 40 with the clip 60 may be inserted into the mounting recess 86 of the cylinder head 80 and thereafter, the rocker arm 10 may be assembled onto the lash adjuster 40.

Figure 3:
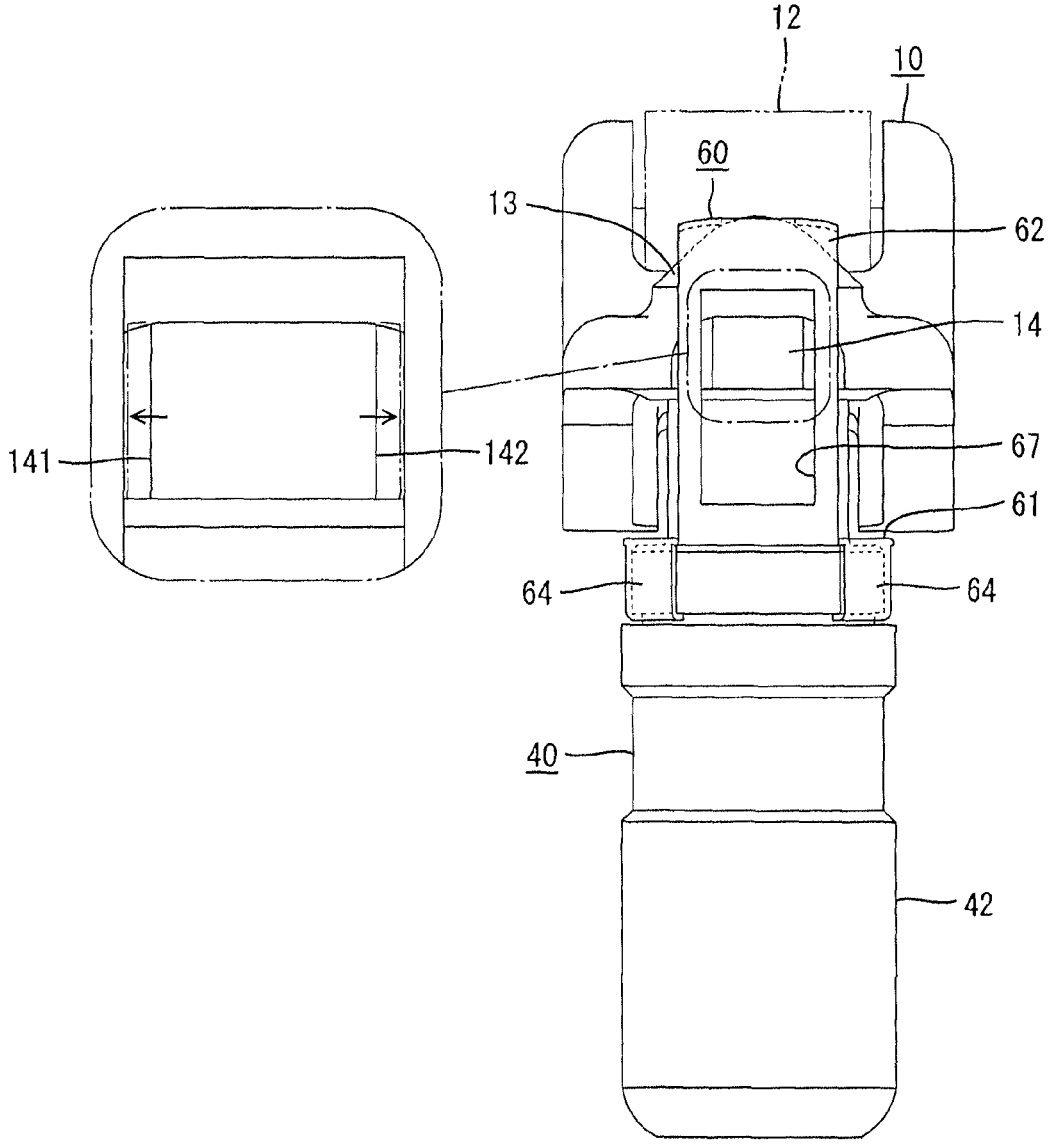
FIG. 3 is a front view of the rocker arm unit.
Figure 4:
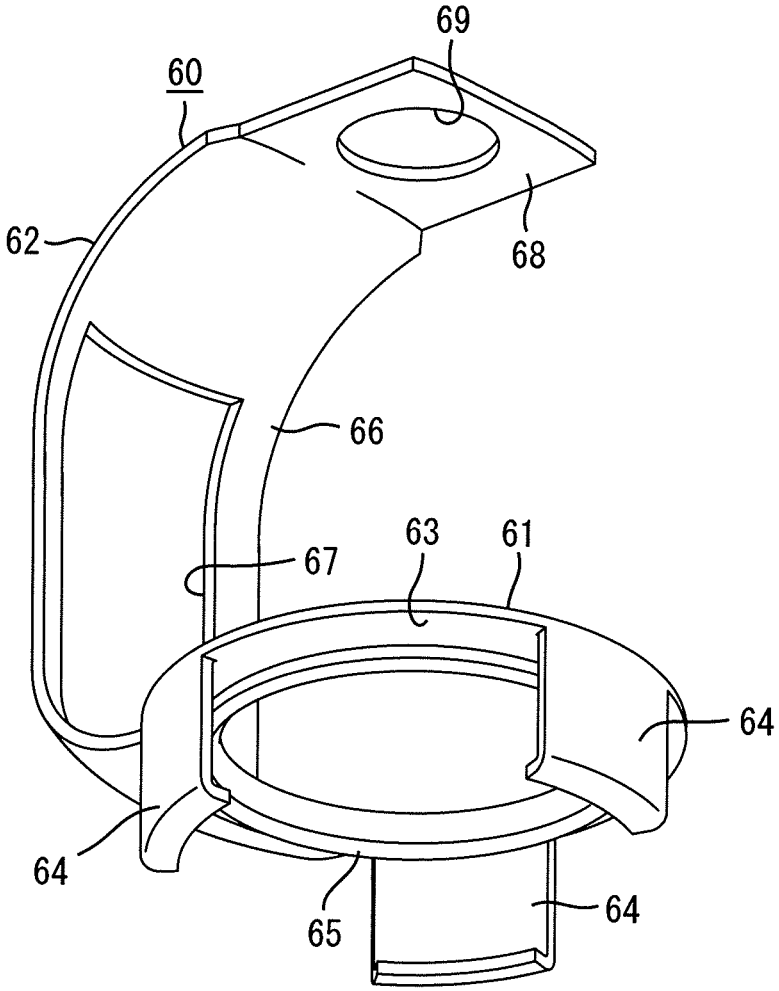
FIG. 4 is a perspective view of a clip.

When the rocker arm 10 is vertically swung with rotation of the cam 90, the outer surface of the support 45 and the bearing surface 18 of the bearing 13 are slid on each other while the rocker arm 10 and the lash adjuster 40 are held in the integral state. Furthermore, since the protrusion 14 of the rocker arm 10 and the opening 67 of the clip 60 are located so as to be abuttable against each other in the direction of movement about the axis of the rocker arm 10, the rotative movement of the protrusion 14 about the axis of the rocker arm 10 relative to the clip 60 is limited, as shown in FIG. 3. The opening 67 has a vertical dimension that is set so that the vertical displacement of the protrusion 14 is allowed at least when the rocker arm 10 is swung.

According to the foregoing embodiment, the clip 60 extending from the lash adjuster 40 side is engaged with the rocker arm 10. This limits the dropout of the rocker arm 10 from the lash adjuster 40. Accordingly, the rocker arm 10 and the lash adjuster 40 can be treated as an integral part, whereupon the assembling efficiency can be improved. Furthermore, since the clip 60 is fixed to the body 42 of the lash adjuster 40, the bearing surface 18 of the bearing 13 of the rocker arm 10 can be prevented from being subjected directly to the fixing force of the clip 60, whereby the smoothness in the swing of the rocker arm 10 can be ensured.

Furthermore, since the clip 60 includes the retainer 61 which prevents the plunger 41 from coming off, the number of parts can be reduced as compared with the case where the clip 60 and the retainer 61 are prepared as independent parts, whereupon the cumbersomeness of parts control can be resolved. In addition, since the clip 60 has a simple construction including the retainer 61 and the extension 62, the material can be rendered economical.

Moreover, since the clip 60 is resiliently abuttable against the rocker arm 10, the rocker arm 10 can easily be assembled onto the lash adjuster 40 while the clip 60 is resiliently deformed. Furthermore, the rotative movement of the rocker arm 10 about the axis thereof relative to the clip 60 is limited by the opening 67 of the clip 60. Accordingly, the rotative movement of the rocker arm 10 about the axis thereof can be prevented from interfering with the assembly and the swinging.

Furthermore, the rocker arm 10 can easily be assembled by utilizing a rising force of the plunger 41 due to the first spring 52. When the rocker arm 10 is inserted sideways into the insertion space 20 between the clip 60 and the plunger 41, the insertion space 20 can be spread while the clip 60 is resiliently deformed. Consequently, the working efficiency can be improved.

Furthermore, since the part of the extension 62 of the clip 60 from the rising portion 66 to the presser portion 68 is formed into the curved shape, the rigidity of the part can be improved and the whole clip 60 can be reinforced.

The clip 60 may be made of a resin. Additionally, the presser portion 68 may be formed by bending the extension 62 toward the upper end of the bearing 13 after the bearing 13 of the rocker arm 10 has been placed on the support 45 of the plunger 41.

The invention claimed is:

1. A rocker arm unit which constitutes a valve gear of an internal combustion engine, comprising:

a plunger formed into a vertically elongated cylindrical shape and having an upper end formed with a hemispherically rounded support, the plunger having an outer circumferential surface formed with a stepped portion, the plunger including an upper part extending upward from the stepped portion and a lower part extending downward from the stepped portion, the upper part having a smaller diameter than the lower part such that the upper part is radially more slender than the lower part;

a vertically extending bottomed cylindrical body and constituting a lash adjuster together with the plunger, the body accommodating the plunger so that the plunger is slidable;

a rocker arm extending in a direction perpendicular to the vertical direction and having two ends in a direction of extension, the rocker arm having a bearing which is formed on one of the ends thereof and has a bearing surface formed into a concave spherical surface receiving the support, the rocker arm having a valve abutment which is formed on the other end thereof and is abutted against an upper end of a valve of the valve gear from above, the rocker arm being swung while an outer surface of the support is slid on the bearing surface of the bearing; and a clip which is configured to be fixed to an upper end of the body and is formed with a retainer having a retaining portion which is configured to be swaged onto an inner circumferential surface of the upper end of the body, the clip further having an extension extending integrally from the retainer, the extension having an upper end which is engaged with the rocker arm thereby to prevent the rocker arm from falling off the lash adjuster, the retaining portion being configured to abut against the stepped portion of the plunger from above thereby to prevent the plunger from coming off upwardly out of the body.

2. The rocker arm unit according to claim 1, wherein the clip is resiliently abuttable against the rocker arm.

3. The rocker arm unit according to claim 1, wherein the upper end of the extension has a presser portion which presses the bearing from above.

4. The rocker arm unit according to claim 3, wherein the presser portion is formed with an entry hole into which the upper end side of the bearing enters and the bearing has an upper end with an outer periphery which is abuttable on an inner edge of the entry hole of the presser portion.

5. The rocker arm unit according to claim 1, wherein the rocker arm includes an end formed with a protrusion, and the clip is formed with an opening through which the protrusion extends.

6. The rocker arm unit according to claim 1, wherein the clip has a whirl-stop portion which locks a part of the rocker arm to limit a rotative movement of the rocker arm about an axis thereof relative to the clip.

7. The rocker arm unit according to claim 1, wherein the rocker arm has an end formed with a protrusion, and the clip is formed with an opening through which the protrusion extends, and the protrusion has two side edges which abut against opposed inner edges of the opening, whereby a rotative movement of the rocker arm about an axis thereof is limited.

8. The rocker arm unit according to claim 1, wherein the retainer has an annular portion attached to a circumference of the upper end of the body; and the extension has a rising portion which extends from an outer circumferential edge of the annular portion so as to be curved outward and subsequently rises substantially upright and is then curved inward from a rising end thereof, the extension further having a presser portion which extends inward substantially horizontally from an upper end of the rising portion thereby to press the rocker arm from above.

9. A method of assembling the rocker arm unit as described in claim 1, comprising:

swaging the retaining portion of the clip on the body;

pressing the plunger downward so that an insertion space for the rocker arm is defined between the clip and the plunger;

inserting the rocker arm into the insertion space; and releasing the plunger from a pressed state thereby to urge the plunger upward so that the rocker arm is interposed between the clip and the plunger.

* * * * *